United States Patent [19]

Moeller

[11] Patent Number: 4,704,589

[45] Date of Patent: Nov. 3, 1987

[54] COMPACT WAVEGUIDE POWER DIVIDER WITH MULTIPLE ISOLATED OUTPUTS

[75] Inventor: Charles P. Moeller, Del Mar, Calif.

[73] Assignee: The United States of America as represented by the United States Department of Energy, Washington, D.C.

[21] Appl. No.: 867,128

[22] Filed: May 27, 1986

[51] Int. Cl.[4] ..... H01P 5/18

[52] U.S. Cl. ..... 333/113; 333/125

[58] Field of Search ..... 333/113, 114, 125, 137

[56] References Cited

U.S. PATENT DOCUMENTS

| | | | |
|---|---|---|---|
| 2,866,595 | 12/1958 | Marie | 333/113 X |
| 3,518,576 | 6/1970 | Algeo | 333/114 |
| 4,520,329 | 5/1985 | D'Oro et al. | 333/113 X |

OTHER PUBLICATIONS

Gormezano et al., *Lower-Hybrid Plasma Heating Via A New Launcher—The Multijunction Grill,* Nucl. Fusion vol. 25, No. 4 (1985), pp. 419–423.

Riblet, *The Short-Slot Hybrid Junction,* Proc. IRE, 40 (Feb. 1952), pp. 180–183.

*Primary Examiner*—Paul Gensler

*Attorney, Agent, or Firm*—Gustavo Siller, Jr.; Paul A. Gottlieb; Judson R. Hightower

[57] ABSTRACT

A waveguide power divider (10) for splitting electromagnetic microwave power and directionally coupling the divided power includes an input waveguide (21) and reduced height output waveguides (23) interconnected by axial slots (22) and matched loads (25) and (26) positioned at the unused ends of input and output guides (21) and (23) respectively. The axial slots are of a length such that the wave in the input waveguide (21) is directionally coupled to the output waveguides (23). The widths of input guide (21) and output guides (23) are equal and the width of axial slots (22) is one half of the width of the input guide (21).

8 Claims, 7 Drawing Figures

COMPACT WAVEGUIDE POWER DIVIDER WITH MULTIPLE ISOLATED OUTPUTS

CONTRACTUAL ORIGIN OF THE INVENTION

The U.S. Government has rights to this invention pursuant to Subsubcontract No. Y4E210 between McDonnell Douglas Astronautics Company and GA Technologies Inc. made under Subcontract No. S002514-F between McDonnell Astronautics Company and Princeton University under Contract No. DE-AC02-76CH03073 between the U.S. Department of Energy and Princeton University.

BACKGROUND OF THE INVENTION

This invention relates to an electromagnetic waveguide power splitter, and more particularly, to a waveguide power splitter having reduced multiple outputs.

Lower hybrid waves are important in thermonuclear fusion research, primarily because of their applications to plasma current drive and heating in tokomaks. Lower hybrid waves are introduced into a fusion reactor vacuum vessel by an array of waveguide launchers. A klystron serves as a generator of the radio frequency (RF) waves. A transmission system carries the RF microwave power from the output ports of the klystron up to the power splitter. The power splitter divides the RF power and couples the divided power to a transmission system leading to the waveguide launchers.

The conventional approach for a lower hybrid wave launcher having a large number of grill elements, where the wave is introduced into the plasma confinement vessel, is to expand the narrow height guides, insert adjustable phase shifters in each arm, and then combine them pairwise using 3-db couplers. This leads to a very large awkward assembly. In addition, this approach requires the use of individual vacuum windows for each grill element.

Another alternative approach is to introduce three equally spaced H-plane partitions into the full size input guide, which then provides four equal power, reduced height outputs. However, in the presence of substantial reflections from the grill, the power will be partially directed back to the other grill elements. For example, if power $P_o$ is returned down one of the reduced height guides, simple transmission line considerations show that 1/7 of that power is coupled to each of the other grill elements, and 4/7 back to the source. This would not only alter phase and amplitude relations, but it would lead to high fields at the leading edges of the partitions. Additionally a large portion of the reflected power would be coupled back to the source.

Therefore, in view of the above, it is an object of the present invention to provide a device for dividing electromagnetic microwave power, propagating in a electromagnetic microwave transmission system.

It is another object of the present invention to provide a device for directionally coupling the divided power output.

It is another object of the present invention to provide a power splitter wherein power reflected back to one of the output waveguides will be substantially absorbed by the output guide, thereby reducing the reflected power coupled back to the source.

It is another object of the present invention to provide a power splitter wherein power reflected back to one of the output waveguides will not be coupled to the other output waveguides.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects and in accordance with the purposes of the present invention, as embodied and broadly claimed herein, the waveguide power divider of this invention may comprise an input waveguide of rectangular cross-section coupled to multiple reduced height output waveguides of rectangular cross-section. The input is coupled to the output waveguides by axial slots. The length of the slots is selected such that the wave direction of the input waveguide is preserved in the output waveguides. The width of the output guide is equal to the width of the input waveguide so that the input and output guides have the same cutoff wavelength. Waves will then travel with the same phase velocity in the input and output guides. The unused ends of the input and output guides are terminated in matched loads. The load at the end of the input guide absorbs power that is not coupled to the output guides. The loads at the end of the output guide absorb power reflected back to the output guides which is not coupled back to the input guide. Power which is reflected back to the output guides is not coupled back into the other output guides. Further, only part of the reflected power is coupled back to the source.

DETAILED DESCRIPTION OF THE INVENTION

Reference will now be made in detail to the present preferred embodiment of the invention, an example of which is illustrated in the accompanying drawings. FIG. 2 shows a transverse cross section of waveguide power divider (10) shown in FIG. 1. The electrical characteristics of rectangular waveguide are determined by the inside dimensions. Regardless of orientation, it is customary to call the shorter dimension, (the dimension in the plane of the electric field) the height, and the longer one the width. Here the waveguide walls having the shorter dimension will be referred to as the side walls and the waveguide walls having the longer dimension will be referred to as the top walls. The length of a waveguide is the dimension in the orientation of wave propagation. The waveguide power divided depicted in FIG. 2 has input waveguide (21) of height $b_o$ and four reduced height output waveguides (23) each of height $b_2$. Input waveguide (21) and output waveguides (23) are coupled by axial slots (22) of height $b_1$. The coupling is through the side wall current which the slots interrupt. Since the side wall current in the Y direction is constant, the coupling of the output waveguides should be equal.

Figure 1:
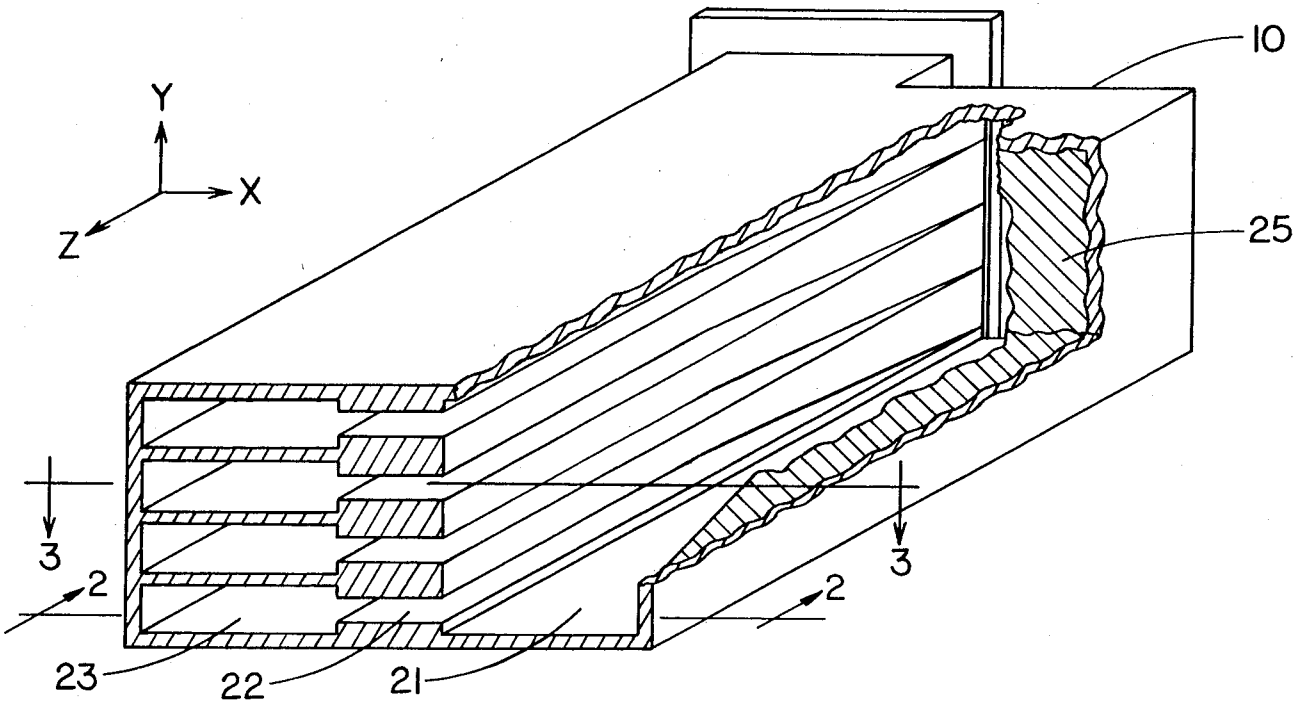
FIG. 1 is a pictorial view of a waveguide power divider having four output waveguides.
Figure 2:
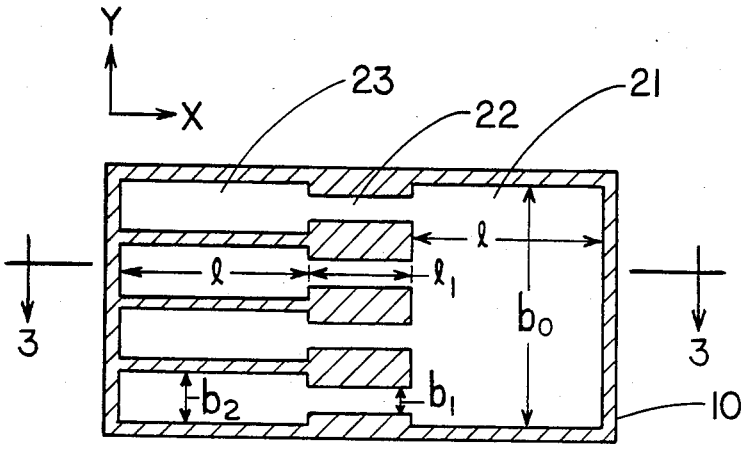
FIG. 2 is a transverse sectional view through plane 2—2, of the waveguide power divider of FIG. 1.
Figure 3:
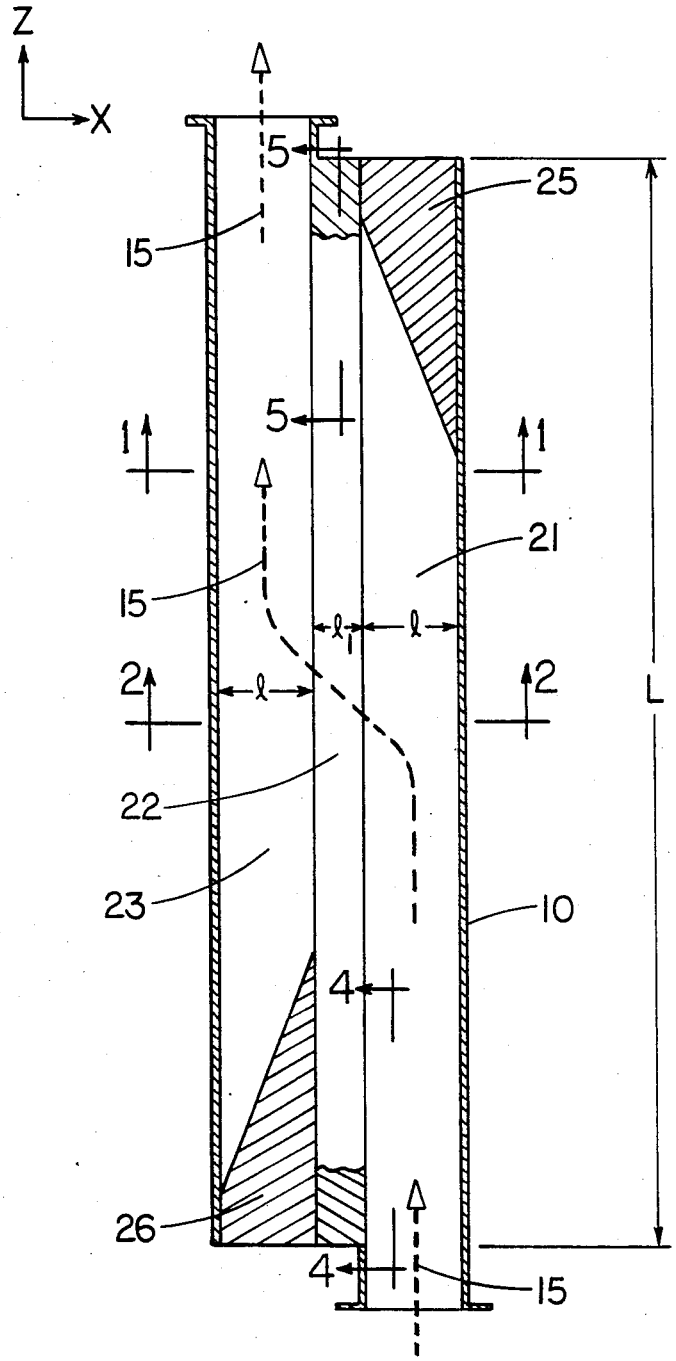
FIG. 3 is a reduced scale longitudinal view, through plane 3—3, of the waveguide power divider of FIG. 1.

A reduced scale longitudinal view of the waveguide power divider of FIG. 1 is shown in FIG. 3. Input waveguide (21) and output waveguides (23) are of the same width l, so that waves travel with the same phase velocity in the two guides. The unused ends of output waveguides (23) are terminated in matched loads (26) which will absorb power incident upon them. The unused end of input waveguide (21) is terminated in matched load (25). Because the length L of slots (23) is many wavelengths long, the power flow is directional, that is, power introduced into input waveguide (21) continues to flow in the same direction as it is coupled into the small output waveguides (23). Power which is not coupled to output guides (23) continues into and is absorbed by the input waveguide matched load (25). Power which is reflected back into output waveguides (23) will be partially coupled into input waveguide (21) and partially coupled back into and absorbed by the output waveguide loads (26). The amount of coupling back to input guide (21) depends on the relative amplitude and phase of the reflected power.

Matched loads are particularly important for the output guides, since power returned to one of output waveguides (23) will be partially absorbed by these loads and partially returned to the generator, but not back to the other output waveguides.

Figure 6:
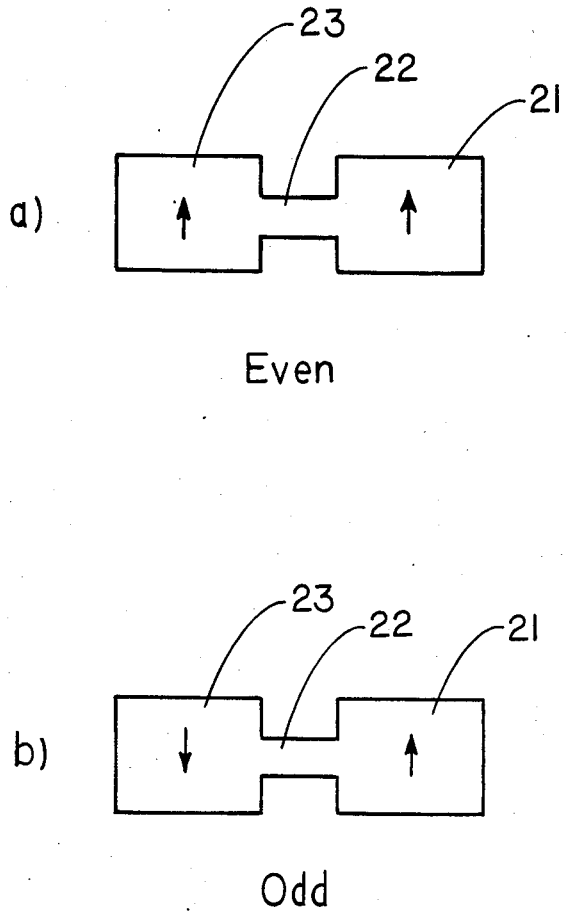
FIG. 6 shows a schematic representation of the even and odd modes.

In order to determine the axial length L required to obtain complete transfer for a given slot height $b_1$ we can regard the output guides as being in parallel, since the side wall current which does the coupling is constant across the side wall. This is based on the observation that the device is a waveguide of very complex crosssection. The power divider can therefore be modeled using only one output guide and one interconnecting slot. The cross-sectional area of the output guide and the cross-sectional area of the interconnecting slot of the model must equal the sum of the cross-sectional areas of the individual output guides and slots respectively. The problem is then reduced to determining the coupling between two guides, as depicted in FIG. 6.

A system of two coupled guides is a cylindrical guide of complex cross-section and possesses normal modes. This means that the fields in all parts of the cross-section propagate with the same wave number $\beta$. The coupling is really determined by the difference in propagation constants of the even mode and odd mode depicted in FIGS. 6(*a*) and 6(*b*) respectively. Here the arrows represent the instantaneous transverse electric field.

The even and odd mode amplitudes can be represented as $$\frac{1}{\sqrt{2}}\begin{pmatrix}1\\1\end{pmatrix} \text{ and } \frac{1}{\sqrt{2}}\begin{pmatrix}1\\-1\end{pmatrix}$$

respectively. In terms of these normal modes, the initial condition with power only in the input guide, can be represented as:

$$\frac{1}{\sqrt{2}}\begin{pmatrix}1\\1\end{pmatrix} + \frac{1}{\sqrt{2}}\begin{pmatrix}1\\-1\end{pmatrix}$$

The condition of complete transfer can be represented as:

$$\frac{1}{\sqrt{2}}\begin{pmatrix}1\\1\end{pmatrix} - \frac{1}{\sqrt{2}}\begin{pmatrix}1\\-1\end{pmatrix}$$

If the axial propagation constants of the even and odd modes are $\beta^+{}_z$ and $\beta^-{}_z$, respectively, then for complete transfer we need the coupling length L to satisfy.

$$(\beta^+{}_z-\beta^-{}_z)L=\pi \tag{1}$$

Figure 7:
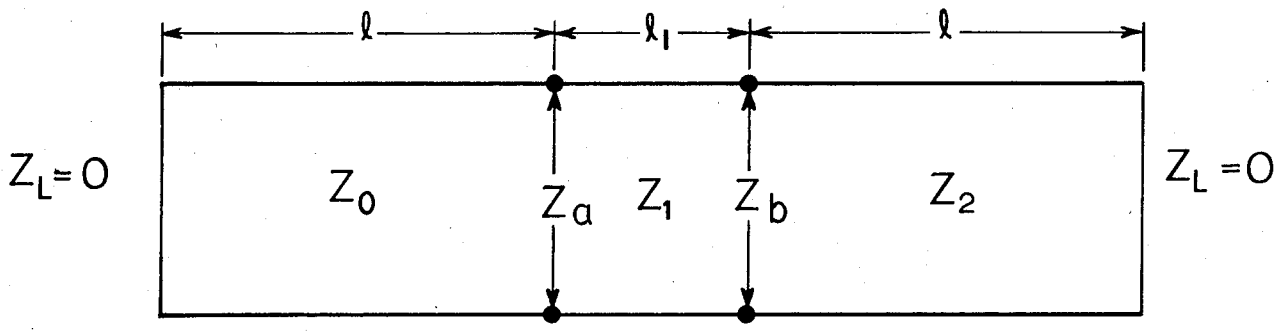
FIG. 7 shows a schematic of the equivalent transmission line formulation of the transverse resonance problem, used in determining characteristics of the power divider.

For a given normal mode, $\beta_z$ is a constant over the cross-section. One can consider Z and Y to be the transverse dimensions and X to be the axial dependence. Therefore, the problem can be modeled as a transmission line having sections of unequal impedance which are joined together, the ends of the sections being shorted out. We must determine the resonances of the sections of the transmission line. A schematic of this transmission line formulation is depicted in FIG. 7, where $Z_0$, $Z_1$ and $Z_2$ are the characteristic impedances of the coupler sections and $Z_a$ and $Z_b$ are resulting impedances at the junctions.

It should be noted that at the junctions of these guides there are discontinuity capacitances $C_a$ and $C_b$. For the lowest modes these capacitances are important because the voltage is maximum at the gap. For the modes of interest here, the discontinuity capacitances have much less effect; because the junctions are at voltage nulls in the limit that the gap vanishes. The only effect of the discontinuity is to make a slight change on the required transverse length of the central region. Therefore, discontinuity capacitances $C_a$ and $C_b$ will be ignored.

For a given normal mode $\beta_z$ is a constant across the cross-section. From the relationship of equation (2)

$$\beta_\perp{}^2+\beta_z{}^2=\omega^2/C^2 \tag{2}$$

where $\omega$=angular frequency and C=speed of light we see that $\beta_\perp$ is also a constant. We can define $\theta=\beta l$ where l is in the width of the waveguides. The characteristic impedance of sections $Z_o$, $Z_1$ and $Z_2$ are proportional to the guide heights $b_o$, $b_1$ and $b_2$ respectively. We will choose $l_1=l/2$.

The following equations are derived from the transmission line formulation.

$$Z_a/Z_o=i\tan\theta \tag{3}$$

$$Z_b/Z_1=(Z_a+iZ_1\tan\theta/2)/(Z_1+iZ_a\tan\theta/2) \tag{4}$$

$$Z_c/Z_2=0=(Z_b+iZ_2\tan\theta)/(Z_2+iZ_b\tan\theta) \tag{5}$$

This leads to equation (6)

$$(Z_1Z_o\tan\theta+Z_1{}^2\tan\theta/2=-Z_2\tan\theta(Z_1-Z_o\tan\theta\tan\theta/2)$$

As the slot gaps go to zero, $Z_1$ goes to zero and equation (6) reduces to $$\tan^2\theta = 0 \text{ or}$$

$$\beta_\perp l = \pi \tag{7}$$

Therefore, if we let $\theta = \pi + \delta$, then $\tan\theta = \tan\delta$ and $\theta/2 = -1/\tan\delta/2$. Assuming $\delta << 1$, $\tan\delta \approx \delta$ and $-1/\tan\delta/2 = -2/\delta$. We then obtain equation 8.

$$\delta^2 \approx \frac{Z_1^2}{Z_0 Z_2 + Z_1(Z_0 + Z_2)/2} = \frac{b_1^2}{b_0 b_2 + b_1(b_0 + b_2)/2} \tag{8}$$

The difference in axial propagation contents is $$\Delta\beta_z = \frac{-\beta_1 \Delta\beta_z}{\beta_z} = \frac{-2\beta_1\delta}{\beta l} \tag{9}$$

substituting into equation (1) yield and expression for the coupling length L $$L = \frac{\pi l \beta_z}{2\beta_1\delta}$$

Figure 5:
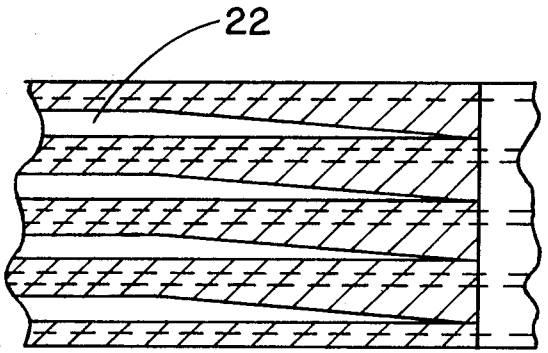
FIGS. 4 and 5 are sectional views through planes 4—4 and 5—5 respectively of FIG. 3, of the waveguide power divider.
Figure 4:
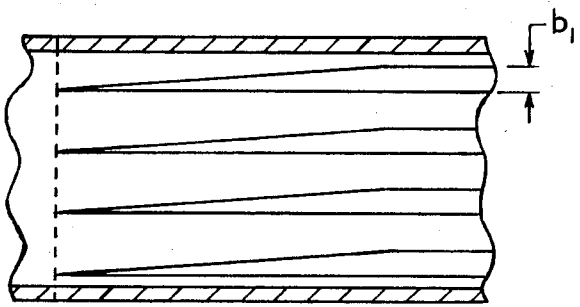

In the preferred embodiment of the present invention the width $l_1$ of coupling gap (22) is one half the width l of input guides (21). Since $\beta l$ is approximately $\pi$ then $l\beta/2$ is approximately $\pi/2$. Therefore the coupling gap acts like a quarter wave transformer, so that each waveguide sees the junction to the coupling gap as a low impedance even when coupling gap (22) has non-zero height. Thus, propagation is only slightly perturbed. Preferably the ends of coupling slots (22) are tapered in order to avoid exciting the ridged guide mode $TE_{10}$ which would be trapped. FIGS. 4 and 5 show a sectional view of the waveguide power divider of FIG. 1 with tapered ends. Although an expression for the coupling length L has been derived for coupling slots of constant height $b_1$ it will be readily apparent to one skilled in the art that the coupling length of a slot with tapered ends can be determined by integrating the expression for $B_z$ over the length of each tapered end.

The following example demonstrates reverse power behavior on a waveguide power divider having four output waveguides. The division of power is examined for power reflected back to only one of the four output guides. This may be of interest if one of the grill elements reflects a substantial amount of power.

In order to analyze the reverse power behavior of the waveguide power splitter, the other normal modes of the system must be considered. Since there are five single mode guides, when the coupling gap has zero height, there are five normal modes with coupling.

Unit amplitude in the input guide can be represented as:

$$\begin{pmatrix} 1 \\ 0 \\ 0 \\ 0 \\ 0 \end{pmatrix}$$

in the top output guide as:

$$\begin{pmatrix} 0 \\ 1 \\ 0 \\ 0 \\ 0 \end{pmatrix} \text{ etc.}$$

The five relevent modes are:

$$\underset{\overline{V}_1}{\frac{1}{\sqrt{2}}\begin{pmatrix} 1 \\ \frac{1}{2} \\ \frac{1}{2} \\ \frac{1}{2} \\ \frac{1}{2} \end{pmatrix}}, \underset{\overline{V}_2}{\frac{1}{\sqrt{2}}\begin{pmatrix} 1 \\ -\frac{1}{2} \\ -\frac{1}{2} \\ -\frac{1}{2} \\ -\frac{1}{2} \end{pmatrix}}, \underset{\overline{V}_3}{\frac{1}{\sqrt{2}}\begin{pmatrix} 0 \\ 1 \\ 1 \\ -1 \\ -1 \end{pmatrix}},$$

$$\underset{\overline{V}_4}{\frac{1}{\sqrt{2}}\begin{pmatrix} 0 \\ 1 \\ -1 \\ 1 \\ -1 \end{pmatrix}}, \underset{\overline{V}_5}{\frac{1}{\sqrt{2}}\begin{pmatrix} 0 \\ 1 \\ -1 \\ -1 \\ 1 \end{pmatrix}}$$

All the vectors are normalized to unit power. $V_1$ and $V_2$ are the even and odd modes discussed previously, and are the only modes excited when the incident power is in the input guide. $V_3$, $V_4$, and $V_5$ represent modes not coupled to the input guide and are only excited when power is incident on guides (23). The condition of unit power incident in the top guide (23), for example, can be written as:

$$\begin{pmatrix} 0 \\ 1 \\ 0 \\ 0 \\ 0 \end{pmatrix} = \frac{\sqrt{2}}{4}(V_1 - V_2 + V_3 + V_4 + V_5).$$

At the output, the amplitude becomes $$\frac{\sqrt{2}}{4}(i\,\overline{V}_1 + i\,\overline{V}_2 + \overline{V}_3 + \overline{V}_4 + \overline{V}_5).$$

This gives a voltage distribution of $$\frac{1}{4}\begin{pmatrix} 2i \\ 3 \\ -1 \\ -1 \\ -1 \end{pmatrix},$$

and a power distribution of $$\begin{pmatrix} \frac{1}{4} \\ 9/16 \\ 1/16 \\ 1/16 \\ 1/16 \end{pmatrix}$$

Therefore more than half of the reflected power remains in the guide which sees the reflected power.

In order to verify the foregoing calculations a 6 GHz scale cavity model having four output waveguides was built. The model was built of aluminum, although it will be readily apparent to those skilled in the art that the interior surfaces of the input and output waveguides can be made of any electromagnetic conducting material. The model had $l=3.667$ cm., $b_o=2.205$ cm, $b_2=0.500$ cm and $b_1=0.127$ cm. Since the four output guides are in series the equivalent heights $b_2'=2.00$ cm. and $b_1'=0.508$ cm. This yields $\delta=0.217$, $\beta_z=0.919$ cm, $\beta=0.857$ cm$^{-1}$, $\Delta\beta_z=0.110$ cm$^{-1}$ which gives the required coupling length $L=28.5$ cm.

The disclosed waveguide power divider thus provides an apparatus for splitting and directionally coupling electromagnetic microwave power. Power reflected back to the disclosed power divider will be partially absorbed by the waveguide in which the reflected power is incident upon and only partially coupled to the power source. The power source can therefore be protected from substantial amounts of reflected power. Further reflected power will be partially coupled to the input waveguide and partially coupled into the output waveguide load but not to the other output waveguide.

The foregoing description of a preferred embodiment of the invention has been presented for purposes of illustration and description. It is not intended to be exhaustive or to limit the invention to the precise form disclosed, and obviously many modifications and variations are possible in light of the above teaching. The other embodiment was chosen and described in order to better explain the principle of the invention and its practical application to thereby enable others skilled in the art to best utilize the invention in various embodiments and with narrow modifications as are suited to the particular use contempleted. It is intended that the scope of the invention be defined by the claims appended hereto.

The embodiments of this invention in which an exclusive property or privilege is claimed are defined as follows:

1. A device for splitting electromagnetic wave power, propagating in an electromagnetic wave transmission system, comprising:

(a) a length of input waveguide of rectangular cross-section said input waveguide having a closed end and an open end; wherein the closed end of the input waveguide is positioned in the direction of electromagnetic wave propagation;

(b) a plurality of output waveguides of rectangular cross-section each having an open end and a closed end, the height of each of said output waveguides being less than the height of said input waveguide, the width of each of said output waveguides being equal to the width of said input waveguide, the closed end of said output waveguides positioned in the direction opposite of the direction of electromagnetic wave propagation, and said output waveguides being successively stacked atop of each other such that an upper output waveguide and an adjacent lower output waveguide have a common top wall there between;

(c) slots of rectangular cross-section for intercommunicating said output waveguides to said input waveguide through a side wall of said input waveguide, the slots being of a length in the direction of electromagnetic wave propagation such that the output waveguides are directionally coupled to the input waveguide.

2. The device of claim 1 wherein the length of said input waveguide and said slots is parallel to the length of said output waveguides.

3. The device of claim 2 wherein the number of intercommunicating slots is equal to the number of output waveguides.

4. The device of claim 3 wherein a matched load is positioned at the closed end of said input waveguide and wherein a matched load is positioned at the closed end of each said output waveguides.

5. The device of claim 4 wherein the width of the intercommunicating slots is one half of the width of the input waveguide.

6. The device of claim 5 wherein the height of the intercommunicating slots is tapered at the ends of said intercommunicating slots.

7. The device of claim 6 wherein the electromagnetic wave power is electromagnetic microwave power.

8. The device of claim 7 wherein there are four output waveguides.

* * * * *